US005765574A

United States Patent [19]

Sheffler et al.

[11] Patent Number: 5,765,574

[45] Date of Patent: Jun. 16, 1998

[54] SAMPLER DEVICE FOR MASCARA AND OTHER COSMETIC SUBSTANCES

[75] Inventors: Robert J. Sheffler, Morganville, N.J.; Charles Chang, 55 Westview Rd., Wayne, N.J. 07470

[73] Assignee: Charles Chang, Wayne, N.J.

[21] Appl. No.: 714,200

[22] Filed: Sep. 16, 1996

[51] Int. Cl.[6] ..... A45D 40/26

[52] U.S. Cl. ..... 132/218; 401/122; 401/128; 132/317

[58] Field of Search ..... 132/218, 320, 132/317, 318, 313; 401/118, 121, 122, 128, 129, 130, 269

[56] References Cited

U.S. PATENT DOCUMENTS

| | | | |
|---|---|---|---|
| 598,474 | 2/1898 | Daniels | 401/129 |
| 1,062,961 | 5/1913 | Funcke | 401/129 |
| 3,891,330 | 6/1975 | Vasas | 401/122 |
| 4,503,872 | 3/1985 | Gueret | 401/122 |
| 4,796,647 | 1/1989 | Gueret | 132/320 |
| 4,826,339 | 5/1989 | Sasaki | 401/269 |
| 4,828,419 | 5/1989 | Porter et al. | 132/317 |
| 5,097,853 | 3/1992 | Nehashi | 132/320 |
| 5,324,128 | 6/1994 | Gueret | 401/129 |

FOREIGN PATENT DOCUMENTS

| | | | |
|---|---|---|---|
| 171983 | 2/1986 | European Pat. Off. | 132/218 |

*Primary Examiner*—Todd E. Manahan

*Attorney, Agent, or Firm*—H. Gibner Lehmann; K. Gibner Lehmann

[57] ABSTRACT

A sampler device for mascara and like cosmetic substances, consists of an elongate tubular container having one end closed and constituting a reservoir or well for holding the cosmetic product. The container has an elongate barrel portion which constitutes a sheath that encloses an intermediate portion of an elongate applicator rod or stick which latter is receivable in the container and held therein with either a snap fit or by means of screw threads. The working end of the applicator rod has a dabber or brush which is lodged in the reservoir of the container; an adjoining portion of the rod seals with the mouth of the container reservoir when the rod is in place. The intermediate portion of the applicator rod joins to an accessible, elongate handle which protrudes from the container and which has, in addition to the snap fit or screw detent device, a sealing means in the form of a resilient ring or gasket that is operative to effect additional sealing when the applicator rod is retained in the container. The two seals minimize contamination of the various parts or soiling of the user's fingers prior to and during use of the device.

26 Claims, 3 Drawing Sheets

35c
12c
18
32c
16
20
33c
62
64
10
26c
14
35d
12d
32d
16d
33d
72
70
68
66
10d
26d
14d
8
12f
32f
32e
33e
76
74

SAMPLER DEVICE FOR MASCARA AND OTHER COSMETIC SUBSTANCES

NO CROSS REFERENCES TO RELATED APPLICATIONS

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates generally to cosmetic samplers, and more particularly to devices having improved sealing characteristics, and low-cost fabrication potential.

2. Description of the Related Art Including Information Disclosed Under 37 CFR §§1.97–1.99

The following references are hereby made of record, as being of interest in the technical field of the invention:
U.S. Pat. Nos.:

| | | |
|---|---|---|
| 2,236,030 | 2,782,438 | 2,866,994 |
| 3,331,094 | 4,710,048 | |

British Pat. No. 845,927

European Published Application No. EP 375 856 A

Considering the references chronologically, U.S. Pat. No. 2,236,030 relates to a cosmetic applicator comprising a container and a brush, and wherein there is provided a passage (6) in the brush, establishing continuous communication between the container interior and the brush when the latter is in position on the container neck.

U.S. Pat. No. 2,782,438 relates to what is known as a "fountain brush", which is adapted for use with paints, lacquers and the like. There is provided a barrel portion or reservoir, and a valving nozzle communicating with the interior of the barrel portion. The valve is normally spring biased to a closed position, and opens upon the brush being momentarily retracted as a consequence of its having been pressed against a writing or painting surface.

U.S. Pat. No. 2,866,994 discloses a somewhat similar fountain brush or applicator, also utilizing a valved nozzle to control the discharge of liquid contained in a barrel portion of the applicator.

U.S. Pat. No. 3,331,094 discloses a metering, brush-type applicator for dispensing medications, cosmetics, paints, ink, or other liquids. The applicator has a brush assembly consisting of a plurality of tufts which are secured to a generally cylindrical, movable valving or metering head.

U.S. Pat. No. 4,710,048 discloses a dispenser for fluids such as glues, solvents, or cosmetic substances, and having a screw cap closure which provides an essentially air-tight chamber for the brush, toward the end of minimizing drying out thereof, between uses.

British Pat. No. 845,927 discloses a paint applicator comprising a squeeze tube having a threaded neck, a brush, and a threaded closure cap. Provision is made for sealing engagement between the edge of the cap and the neck of the tube in the closed condition of the applicator, and for minimizing distortion of the cap in the event of overtightening of the cap and neck threads.

European Published Application No. EP 375 856 A2 discloses a mascara applicator comprising a brush part and a cap part, and wherein an internal ring in the cap part is utilized to remove dust from the brush tip as it is being re-inserted into the cap part.

It is considered that few, if any, of the above-identified applicator arrangements have had significant impact in the marketplace, and accordingly there has existed a long-felt need for an applicator construction especially adapted for mascara, and in an essentially single-use, sampler-type package.

SUMMARY OF THE INVENTION

Accordingly, one object of the present invention is to provide a novel and improved sampler device for mascara and the like, which is especially simple in its structure and which features novel sealing structures that insure effective isolation of the mascara product during storage and prior to use, so as to completely avoid inadvertent spillage of the product, or soiling of the user's hands, clothing, etc.

Yet another object of the invention is to provide an improved sampler device as above set forth, which is characterized by a double seal, one at the reservoir or well which contains the cosmetic product, and a second at the mouth of the barrel portion of the sampler, the latter effectively isolating the entire unit, excepting a small portion of the applicator rod or stick, from the areas exterior to the barrel portion and rod.

Still another object of the invention is to provide an improved sampler device in accordance with the foregoing, which utilizes a minimum number of separate components, and is thereby economical to manufacture and assemble.

Still another object of the invention is to provide an improved sampler device in accordance with the foregoing, which is sufficiently inexpensive so as to render it practical as a single-use or single-application device, as in salons or at cosmetic counters, where a potential buyer can apply a small quantity from the sampler, and immediately see the effect; the sampler can then be merely discarded, wherein product waste is kept to an absolute minimum.

The above objects are accomplished by a sampler device for mascara and like cosmetic products, comprising in combination an elongate tubular container having a closed end portion constituting a reservoir or well in which the cosmetic product can be deposited and carried, the container having a barrel portion constituting a sheath and the barrel portion being connected to the reservoir at a juncture and having at its free end an open mouth; the sampler device further comprises an elongate applicator rod or stick adapted to be inserted in the container through the open mouth. The applicator rod has a handle at one end and a dabber at the other end. The dabber may be a spiral-wound brush, sponge mitt, flocked member or deersfoot brush. The applicator rod has an elongate intermediate portion connecting the handle and dabber to each other and occupying the barrel portion of the container, while the dabber occupies the reservoir portion of the container when the applicator rod is inserted in and carried thereby. There are provided cooperable separable sealing means located on the intermediate portion of the applicator rod and adjacent the juncture of the reservoir and barrel, for sealing the cosmetic product in the reservoir.

The arrangement is such that the mascara or other cosmetic product is effectively isolated in the interior of the reservoir and on the dabber, minimizing any tendency for contamination or leakage, and also minimizing soiling of the user's hands or clothing, during use.

Other features and advantages will hereinafter appear.

BRIEF DESCRIPTION OF THE DRAWINGS

In the accompanying drawings, illustrating several different embodiments of the invention.

DESCRIPTION OF THE PREFERRED EMBODIMENTS

Figures 1, 2, 3, 4, 5:
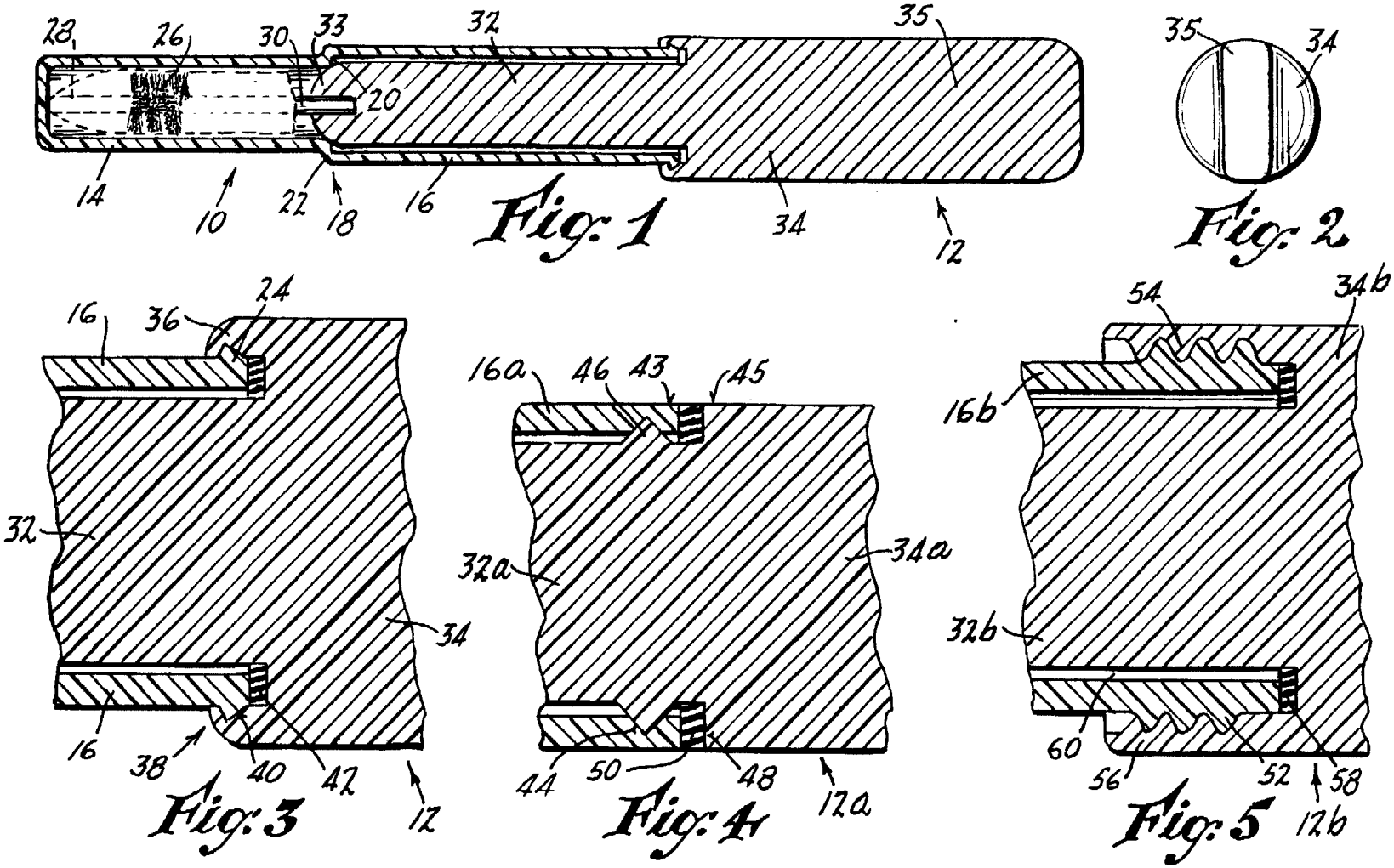
FIG. 1 is an axial sectional view of the improved cosmetic sampler as provided by the invention.
FIG. 2 is a right end elevation of the sampler of FIG. 1.
FIG. 3 is a fragmentary enlarged detail of the snap-fit and sealing connection shown in FIG. 1, between the container and applicator parts of the sampler.
FIG. 4 is a view like that of FIG. 3 but illustrating another embodiment of the invention.
FIG. 5 is a view like those of FIGS. 3 and 4 but illustrating still another embodiment of the invention.

Referring first to FIGS. 1–3, the present improved sampler device for cosmetic products comprises a unique elongate tubular container designated generally by the numeral 10, in which there is carried an elongate applicator rod or stick indicated generally by the numeral 12. The container 10 can be advantageously fabricated as an injection molded plastic piece, although it could as well be formed as a blow molded bottle or as a deep drawn metal shell, of anodized aluminum for example.

As seen in FIG. 1, the novel container 10 of the invention has a closed tubular end portion constituting a reservoir or well 14 in which the cosmetic product (not shown) can be deposited. At its open end, the reservoir 14 is joined to a cylindrical barrel portion 16 which, according to the invention, is of somewhat larger diameter than the reservoir 14. The axial lengths of the reservoir 14 and barrel portion 16 of the container 10 are somewhat commensurate, with the barrel portion 16 having a slightly greater axial length.

A juncture 18 joins the reservoir and barrel portion, such juncture being in the form of an annular enlargement of the reservoir, creating inner and outer shoulders 20 and 22 respectively.

At its unattached end the barrel portion 16 is provided with an exterior annular, V-section bead 24 which constitutes part of a snap-fit connection of the barrel portion 16 to the applicator rod 12, FIG. 3.

For cooperation with the container 10 the unique applicator rod or stick comprises a dabber 26 which can be advantageously constituted as a spiral-wound brush, foamed mitt with internal stiffener, flocked head or deersfoot brush, all the constructions of which per se, are well known. The dabber 26 preferably has a cone-shaped nose or end portion 28, and has a stem or shank 30 which is firmly embedded in an elongate intermediate portion 32 of the applicator rod 12.

Joined to the intermediate portion 32 of the applicator rod is an oar-like handle 34 which has a flatted end portion 35 as seen in FIG. 2. Preferably the handle 34 and the intermediate portion 32 are integral with each other, being molded of suitable thermoplastic substance. At the molding thereof, the dabber stem 30 could be incorporated in the rod, being used as an insert in the molds. More frequently, the wire portion of the spiral-wound brush is heated and inserted into the rod which melts and flows around the wire shank, subsequently cooling and solidifying around the wire, so as to anchor it.

The handle 34 is of larger diameter than the intermediate portion 32, forming at the junction 38 an undercut flange or shoulder 36 having an annular groove 40 where the end of the barrel portion 16 terminates. Specifically, the flange 36 has the groove 40 in its inside surface in the form of an annular V-section undercut which forms the groove 40 and which accommodates the annular bead 24 of the barrel portion 16 of the container.

With this construction there is provided, by the invention, a simple and effective snap-fit connection between the container 10 and the applicator 12. Further, the invention provides an effective seal at such snap-fit connection. Disposed within the confines of the shoulder 36 there is a resilient sealing annulus or gasket 42 which is engaged by the end of the barrel portion 16 at the time that said end occupies the junction 38. This forms an air-tight and liquid-tight joint, as well as eliminating any looseness or poor fit.

An important feature of the invention resides in the seal which is provided at the mouth of the reservoir 14. Referring to FIG. 1, the juncture 18 comprises an annular internal shoulder 20 at the reservoir mouth. The inner end 33 of the intermediate portion 32 of the applicator rod is rounded, as shown, and arranged to provide a snug fit with the shoulder 20 at the time that the snap-fit connection is established between the barrel portion 16 and the handle 34 of the applicator. Such seal effectively contains the cosmetic product in the reservoir 14, which is being occupied by the brush or dabber 26.

Another embodiment of the invention is illustrated in FIG. 4, wherein a different snap-fit connection is shown, having flush, streamlined surfaces. As illustrated, a barrel portion 16*a* at its mouth or open end is provided with a V-section annular internal groove 44 which receives a V-section annular bead 46 on the intermediate portion 32*a* of an applicator 12*a* having a handle 34*a*. At the juncture of the intermediate portion 32*a* and the handle 34*a* an exterior shoulder 48 is provided, against which a resilient sealing washer, gasket or annulus 50 rests. When the barrel portion 16*a* is snapped over the annular bead 46, the end of the barrel portion engages and seals against the gasket 50. In other respects, the sampler of FIG. 4 is similar generally to the sampler of FIGS. 1–3.

Yet another embodiment of the invention is shown in FIG. 5, which has a screw-thread arrangement for securing the applicator to the container, in place of a snap-fit. In this figure, the barrel portion 16*b* has external threads 52 which are engaged by internal threads 54 in a connector portion 56 of a handle 34b of an applicator. A resilient gasket or ring 58 is engaged by the end of the barrel portion 16b, such gasket being disposed at the end portion of an annular space 60 formed between the connector portion 56 and the intermediate portion 32b of the applicator.

Figures 6, 7, 8, 9, 10:
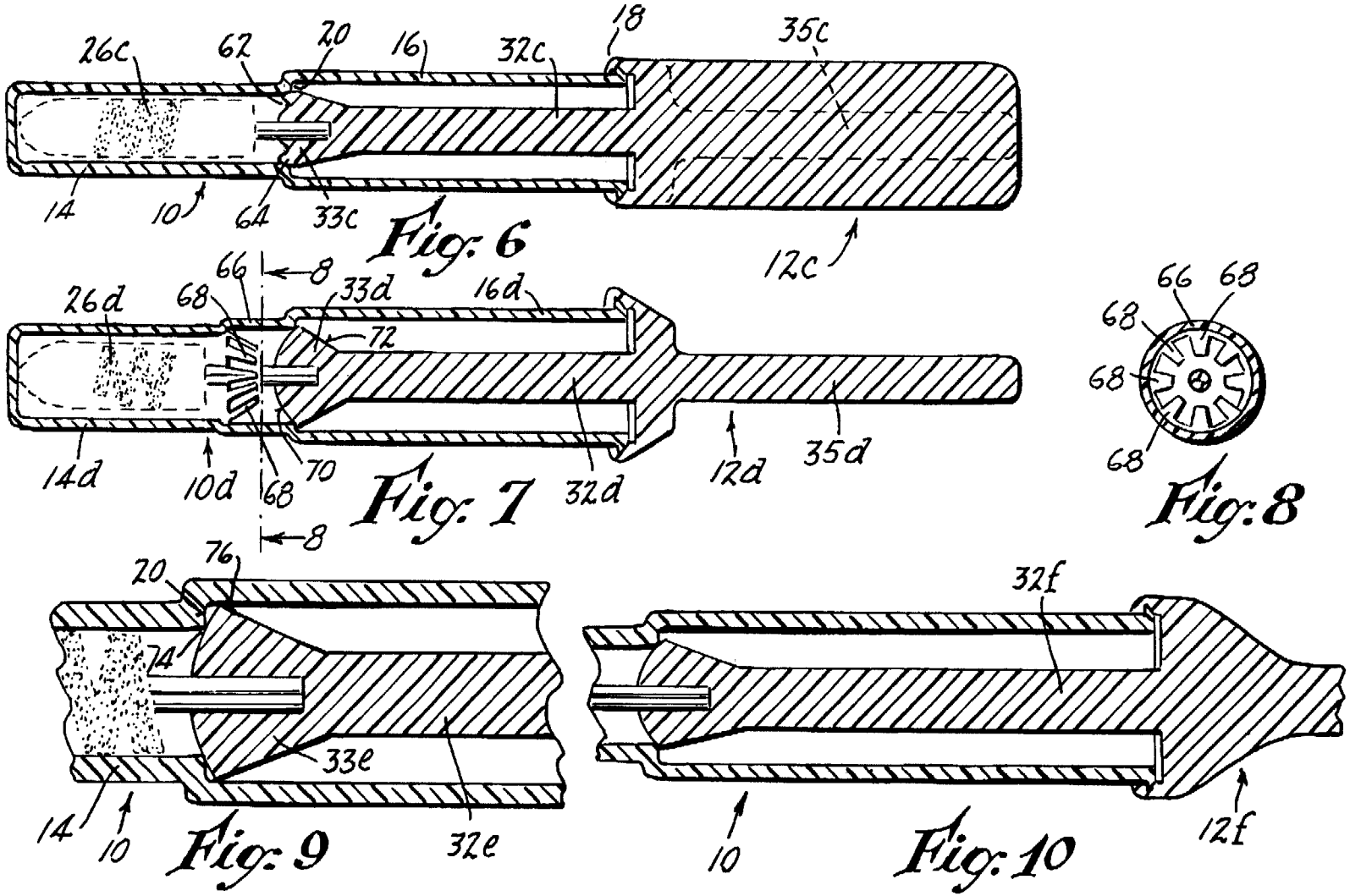
FIG. 6 is an axial sectional view similar to that of FIG. 1 but showing still another embodiment of the invention, having a modified valving seal for the reservoir contents.
FIG. 7 is a similar axial sectional view but of a different embodiment of the invention, featuring an internal, segmented wiper that is integrally formed with the container for the product.
FIG. 8 is a transverse section taken on the line 8—8 of FIG. 7.
FIG. 9 is a fragmentary axial sectional enlargement of another embodiment of the invention, featuring a double seal at the mouth of the reservoir for the product.
FIG. 10 is a view like that of FIG. 9, but illustrating yet another embodiment of the invention which features simplification of the shapes of the applicator and a reduced diameter of an intermediate portion of the applicator rod.

Another embodiment of the invention is illustrated in FIG. 6, which shows a modified configuration of the valving portion of the applicator rod to effect a softer sealing action. In this and other succeeding figures, portions of the sampler device which are similar to those previously described are given identical numbers.

The container 10 has a reservoir portion 14 and a barrel portion 16, the latter being characterized by a snap fit with a modified applicator rod 12c. The rod 12c includes a dabber 26c and a handle portion 35c; the sampler of this figure is seen to have a snap connection 18 between the container 10 and the applicator rod 12c that is similar to the juncture or connection 18 already described above.

The applicator rod 12c has an intermediate portion 32c which is of smaller diameter than the portion 32 previously explained, such portion having a modified valving configuration comprising the inner end 33c of the portion 32c, the end 33c being of generally conical shape. The end 33c has a base surface that is provided with an annular groove 62 which has the effect of adding flexibility to the edge 64 of the base, enabling such edge to more easily conform to and seal against the shoulder 20 of the reservoir. The reduced diameter of the intermediate portion 32c results in a saving of plastic substance of which the applicator rod 12c is molded.

The dotted outline of the flatted handle portion 35c shown in FIG. 6 indicates how a saving in the amount of molding material can be effected by making the handle in the form of an oar-like, flat blade.

Another embodiment of the invention is illustrated in FIGS. 7 and 8, wherein a container 10d has stepped walls providing a small diameter reservoir portion 14d, a larger diameter barrel or sheath portion 16d, and an intermediary connector and valving portion 66 which latter houses an internal, integral and segmented wiper comprising obliquely extending blades 68 adapted to wipe excess product from the dabber 26d as the applicator rod 12d is withdrawn from the container 10d. The blades 68 are molded at the time that the container is molded so as to be integral therewith.

The applicator rod 12d has a handle 35d and a bulbous end or valve portion 33d provided with a spherical valving surface 70 and a conical back surface 72 which latter merges with the intermediate rod portion 32d. The embodiment of FIGS. 7 and 8 thus provides a simple and effective integral internal wiper means for the dabber 26d, with an applicator rod which is saving of molding material and simple in configuration.

Yet another embodiment of the invention is shown in FIG. 9, wherein an applicator rod portion 32e has a valving end or head 33e which is configured to seal with the shoulder or valve seat 20 of a container 10 at two annular rings of contact 74 and 76. This provides a double seal and double assurance against leakage of the product from the reservoir 14 of the container 10.

Still another embodiment of the invention is shown in FIG. 10, representing a refinement of the sampler wherein the applicator rod 12f is of the simplest configuration, having an intermediate, reduced-diameter portion 32f requiring the least amount of plastic molding material in its production.

Figure 11:
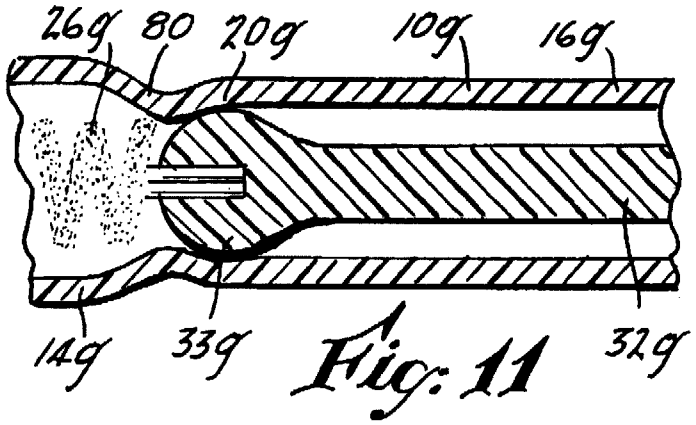
FIG. 11 is a fragmentary sectional view of yet another embodiment of the invention, wherein the walls of the reservoir are slightly constricted at the internal valving location, to provide a slight wiping action on the dabber as the applicator rod is being withdrawn from the container.

A further embodiment of the invention is shown in FIG. 11, involving a wall constriction of the container or reservoir mouth or valve seat, to effect a slight wiping of the dabber as the applicator rod is removed. As seen in this figure, a container 10g has a reservoir portion 14g and a barrel portion 16g, joined to each other by a valving or valve seat portion 80 providing a shoulder or valve seat 20g. Cooperable with the valve seat 20g is a spherical end or valve 33g at the extremity of an intermediate applicator rod portion 32g. The valve seat portion 80 has an internal diameter that is slightly smaller than the diameter of the dabber 26g, whereby withdrawal of the applicator rod will cause the valving portion 80 to wipe excess product from the dabber 26g. The extent of restriction can be greater or lesser, to control the extent of the wiping action.

Figure 12:
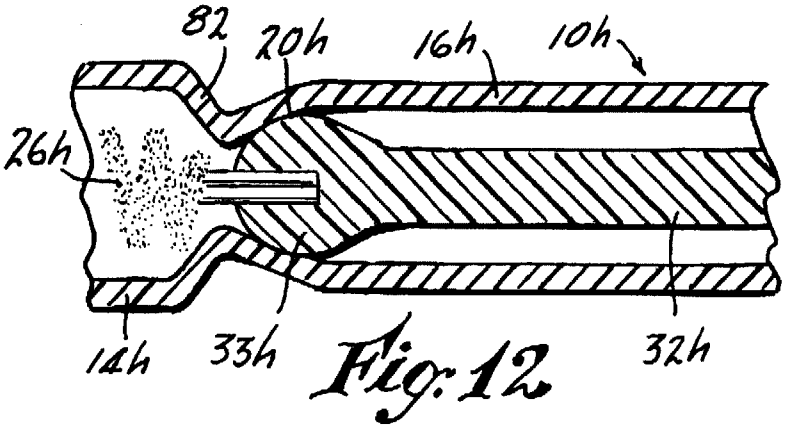
FIG. 12 is a view like that of FIG. 11 but showing a more pronounced constricting of the reservoir walls, to produce a heavier wiping action on the dabber as it is being withdrawn from the container.

In FIG. 12 a sampler construction is shown, where a greater extent of constriction of the valve portion is indicated. In this figure the container 10h having the barrel portion 16h and reservoir portion 14h has a more pronounced constricted portion 82 which provides a shoulder or valve seat 20h. The constricted portion is formed by two hollow frusta portions, joined end to end as shown. The applicator rod 32h has an end or valve head 33h which seats against the valve seat 20h. Due to the much smaller diameter of the portion 82 and seat 20h, a heavier wiping action on the dabber 26h is had, to remove more of the cosmetic product from the dabber as it is being withdrawn from the container 10h.

It will now be understood that we have provided, by this invention, improved yet simple and inexpensive sampler devices which enable various cosmetic products such as mascara and the like to be conveniently sampled, at low cost. The various components are few in number, inexpensively produced and assembled in large quantities, and especially adapted for single-use, sampling and throw-away purposes.

The improved cosmetic samplers also feature improved sealing characteristics compared to prior devices of this type.

Inadvertent soiling of the user's hands or clothing is eliminated, as a consequence of the virtual complete isolation of the cosmetic product to the reservoir of the sampler, prior to the first use.

The disclosed devices are thus seen to represent a distinct advance and improvement in the field of cosmetic dispensers.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is claimed is:

1. A sampler device for mascara and like cosmetic substances, comprising in combination:

a) an elongate tubular container having a closed end portion constituting a well in which the cosmetic substance can be deposited and carried, said well having an imperforate side wall, b) said container having a barrel portion which is integral with the well and which constitutes a sheath, c) said barrel portion being connected to said well by an integral juncture providing an internal annular shoulder and said well having at its free end an open mouth, d) an elongate applicator stick adapted to be inserted in the container through said open mouth, said applicator stick having a handle at one of its ends and having a dabber at the other of its ends, e) said applicator stick having an elongate intermediate portion connecting said handle and dabber to each other.

f) the elongate intermediate portion of the applicator stick occupying the barrel portion of the container and said dabber occupying the well of the container when the applicator stick is inserted in and carried by said container, and g) cooperable separable sealing means located on the intermediate portion of the applicator stick and comprising said internal annular shoulder at the juncture of said well and barrel portion, for sealing the cosmetic substance in said well.

2. A sampler device as set forth in claim 1, wherein:

a) the barrel portion of the container has a larger diameter than the well thereof.

3. A sampler device as set forth in claim 1, and further including:

a) an additional sealing means between the container and applicator stick, b) said additional sealing means being engageable with the handle of the applicator stick and the mouth of the container barrel portion.

4. A sampler device as set forth in claim 3, wherein:

a) the additional sealing means comprises a resilient annulus disposed between the said handle and intermediate portion of the applicator stick and engaged with the said mouth of the barrel portion of the container.

5. A sampler device as set forth in claim 1, wherein:

a) the juncture of the applicator stick handle and the dabber substantially coincides with the integral shoulder of the container when the applicator stick is inserted therein, thereby to isolate the cosmetic substance from the handle during storage and shipping.

6. A sampler device as set forth in claim 1, wherein:

a) said dabber has a width which is substantially the same as the diameter of the well, so as to physically contact the walls of the same and be brushed thereby as the applicator stick is withdrawn from the container.

7. A sampler device as set forth in claim 1, wherein:

a) the cooperable sealing means comprises a rounded annular portion of the applicator stick, engaged with the said internal shoulder.

8. A sampler device as set forth in claim 1, and further including:

a) means in the barrel portion of the container, providing an internal wiper for the dabber when the applicator stick is withdrawn from the container.

9. A sampler device as set forth in claim 1, wherein:

a) the barrel portion of the container is provided with a constriction disposed intermediate the juncture of the well and barrel portion, b) the inside diameter of the constriction being smaller than the dimension of the dabber, whereby there occurs a wiping of the dabber as the applicator stick is withdrawn from the container.

10. A sampler device as set forth in claim 1, wherein:

a) the cross dimension of the dabber is less than the cross dimension of the barrel portion of the container.

11. A sampler device as set forth in claim 1, wherein:

a) the barrel portion of the container telescopically fits into the handle of the applicator stick.

12. A sampler device as set forth in claim 1, wherein:

a) the intermediate portion of the applicator stick telescopically fits into the barrel portion of the container and has a shouldered area which is flush with the outside of the barrel portion of the container.

13. A sampler device as set forth in claim 12, and further including:

a) a seal between the container and applicator stick, comprising a resilient annular sealing washer engaged with the shouldered area of the barrel portion of the container.

14. A sampler device as set forth in claim 1, wherein:

a) the barrel portion of the container has exterior threads and the handle of the applicator stick has interior threads which are cooperable with the exterior threads of said barrel portion to effect a connection therebetween.

15. A sampler device as set forth in claim 1, wherein:

a) said container has stepped walls forming said shoulder, said shoulder being sealingly engaged by said applicator stick, and constituting said sealing means.

16. A sampler device as set forth in claim 1, wherein:

a) said sheath houses an internal, integral and segmented wiper comprising obliquely extending blades adapted to wipe excess product from the dabber as the applicator stick is withdrawn from the container.

17. A sampler device as set forth in claim 16 wherein:

a) said blades exceed two in number, and are symmetrically disposed about the axis of the applicator stick.

18. A sampler device for mascara and like cosmetic substances, comprising in combination:

a) an elongate tubular container having a closed end portion constituting a well in which the cosmetic substance can be deposited and carried, b) said container having a barrel portion constituting a sheath, c) said barrel portion being connected to said well at a juncture and having at its free end an open mouth, d) an elongate applicator stick adapted to be inserted in the container through said open mouth, said applicator stick having a handle at one of its ends and having a dabber at the other of its ends, e) said applicator stick having an elongate intermediate portion connecting said handle and dabber to each other, f) the elongate intermediate portion of the applicator stick occupying the barrel portion of the container and said dabber occupying the well of the container when the applicator stick is inserted in and carried by said container, g) cooperable separable sealing means located on the intermediate portion of the applicator stick and adjacent the juncture of said well and barrel portion, for sealing the cosmetic substance in said well, h) an additional sealing means between the container and applicator stick, i) said additional sealing means being engageable with the handle and the mouth of the container barrel, and j) a snap detent joint between the container and applicator stick, k) said snap joint being located adjacent the said additional sealing means.

19. A sampler device as set forth in claim 18, wherein:

a) said snap joint comprises exterior surfaces of the container and applicator stick which are flush with each other.

20. A sampler device for mascara and like cosmetic substances, comprising in combination:

a) an elongate tubular container having a closed end portion constituting a well in which the cosmetic substance can be deposited and carried, b) said container having a barrel portion constituting a sheath, c) said barrel portion being connected to said well at a juncture and having at its free end an open mouth, d) an elongate applicator stick adapted to be inserted in the container through said open mouth, said applicator stick having a handle at one of its ends and having a dabber at the other of its ends, e) said applicator stick having an elongate intermediate portion connecting said handle and dabber to each other, f) the elongate intermediate portion of the applicator stick occupying the barrel portion of the container and said dabber occupying the well of the container when the applicator stick is inserted in and carried by said container, and g) cooperable separable sealing means located on the intermediate portion of the applicator stick and adjacent the juncture of said well and barrel portion, for sealing the cosmetic substance in said well, h) said sealing means comprising two annular areas of contact at the juncture of the well and the barrel portion, and a valving head of bulbous configuration on the applicator stick, which head is engageable with both areas of contact simultaneously, to thereby provide a double seal.

21. A sampler device as set forth in claim wherein one area lies radially outside the other.

22. A sampler device for mascara and like cosmetic substances, comprising in combination:

a) an elongate tubular container having a closed end portion constituting a well in which the cosmetic substance can be deposited and carried, b) said container having a barrel portion constituting a sheath, c) said barrel portion being connected to said well at a juncture and having at its free end an open mouth, d) an elongate applicator stick adapted to be inserted in the container through said open mouth, said applicator stick having a handle at one of its ends and having a dabber at the other of its ends, e) said applicator stick having an elongate intermediate portion connecting said handle and dabber to each other, f) the elongate intermediate portion of the applicator stick occupying the barrel portion of the container and said dabber occupying the well of the container when the applicator stick is inserted in and carried by said container, g) cooperable separable sealing means located on the intermediate portion of the applicator stick and adjacent the juncture of said well and barrel portion, for sealing the cosmetic substance in said well, h) an additional sealing means between the container and applicator stick, i) said additional sealing means being engageable with the handle and the mouth of the container barrel, and j) a screw thread connection between the container and applicator stick, k) said screw thread connection being located adjacent the said additional sealing means.

23. A sampler device for mascara and like cosmetic substances, comprising in combination:

a) an elongate tubular container having a closed end portion constituting a well in which the cosmetic substance can be deposited and carried, b) said container having a barrel portion constituting a sheath, c) said barrel portion being connected to said well at a juncture and having at its free end an open mouth, d) an elongate applicator stick adapted to be inserted in the container through said open mouth, said applicator stick having a handle at one of its ends and having a dabber at the other of its ends, e) said applicator stick having an elongate intermediate portion connecting said handle and dabber to each other, f) the elongate intermediate portion of the applicator stick occupying the barrel portion of the container and said dabber occupying the well of the container when the applicator stick is inserted in and carried by said container, g) cooperable separable sealing means located on the intermediate portion of the applicator stick and adjacent the juncture of said well and barrel portion, for sealing the cosmetic substance in said well, h) the barrel portion of the container having exterior threads and the handle of the applicator stick having interior threads which are cooperable with the exterior threads of said barrel portion to effect a connection therebetween, and i) a seal between the barrel portion of the container and the handle of the applicator stick, j) said seal comprising a resilient annular ring located adjacent the said cooperable threads.

24. A sampler device for mascara and like cosmetic substances, comprising in combination:

a) an elongate tubular container having a closed end portion constituting a well in which the cosmetic substance can be deposited and carried, b) said container having a barrel portion constituting a sheath, c) said barrel portion being connected to said well at a juncture and having at its free end an open mouth, d) an elongate applicator stick adapted to be inserted in the container through said open mouth, said applicator stick having a handle at one of its ends and having a dabber at the other of its ends, e) said applicator stick having an elongate intermediate portion connecting said handle and dabber to each other, f) the elongate intermediate portion of the applicator stick occupying the barrel portion of the container and said dabber occupying the well of the container when the applicator stick is inserted in and carried by said container, and g) cooperable separable sealing means located on the intermediate portion of the applicator stick and adjacent the juncture of said well and barrel portion, for sealing the cosmetic substance in said well, h) said cooperable sealing means comprising a conical head portion of the applicator stick, said head portion having a base surface with an annular groove, the outer wall of the annular groove being resilient and flexible so as to enable it to sealingly engage the juncture of the well and barrel portion.

25. A sampler device for mascara and like cosmetic substances, comprising in combination:

a) an elongate tubular container having a closed end portion constituting a well in which the cosmetic substance can be deposited and carried, b) said container having a barrel portion constituting a sheath, c) said barrel portion being connected to said well at a juncture and having at its free end an open mouth, d) an elongate applicator stick adapted to be inserted in the container through said open mouth, said applicator stick having a handle at one of its ends and having a dabber at the other of its ends, e) said applicator stick having an elongate intermediate portion connecting said handle and dabber to each other, f) the elongate intermediate portion of the applicator stick occupying the barrel portion of the container and said dabber occupying the well of the container when the applicator stick is inserted in and carried by said container, and g) cooperable separable sealing means located on the intermediate portion of the applicator stick and adjacent the juncture of said well and barrel portion, for sealing the cosmetic substance in said well, h) said sealing means comprising a bulbous valve portion on said applicator stick, said bulbous valve portion having a spherical valving surface and a conical back surface, the latter merging with the intermediate portion of the applicator stick.

26. A sampler device for mascara and like cosmetic substances, comprising in combination:

a) an elongate tubular container having a closed end portion constituting a well in which the cosmetic substance can be deposited and carried, b) said container having a barrel portion constituting a sheath, c) said barrel portion being connected to said well at a juncture and having at its free end an open mouth, d) an elongate applicator stick adapted to be inserted in the container through said open mouth, said applicator stick having a handle at one of its ends and having a dabber at the other of its ends, e) said applicator stick having an elongate intermediate portion connecting said handle and dabber to each other, f) the elongate intermediate portion of the applicator stick occupying the barrel portion of the container and said dabber occupying the well of the container when the applicator stick is inserted in and carried by said container, and g) cooperable separable sealing means located on the intermediate portion of the applicator stick and adjacent the juncture of said well and barrel portion, for sealing the cosmetic substance in said well, h) the barrel portion of the container being provided with a constriction disposed intermediate the juncture of the well and barrel portion, i) the inside diameter of the constriction being smaller than the dimension of the dabber, whereby there occurs a wiping of the dabber as the applicator stick is withdrawn from the container, j) said sealing means comprising a bulbous valving head on the applicator stick, and the inner wall surface of said constriction.

* * * * *